US010329873B2

(12) United States Patent
Mullen, II

(10) Patent No.: US 10,329,873 B2
(45) Date of Patent: Jun. 25, 2019

(54) METHODS FOR CEMENTING A SUBTERRANEAN WELLBORE

(71) Applicant: EOG Resources, Inc., Houston, TX (US)

(72) Inventor: James C. Mullen, II, Tyler, TX (US)

(73) Assignee: EOG RESOURCES, INC., Houston, TX (US)

( * ) Notice: Subject to any disclaimer, the term of this patent is extended or adjusted under 35 U.S.C. 154(b) by 0 days.

(21) Appl. No.: 15/685,992

(22) Filed: Aug. 24, 2017

(65) Prior Publication Data

US 2018/0058175 A1 Mar. 1, 2018

Related U.S. Application Data

(60) Provisional application No. 62/378,781, filed on Aug. 24, 2016.

(51) Int. Cl.

| | |
|---|---|
| ***E21B 43/16*** | (2006.01) |
| ***E21B 33/14*** | (2006.01) |
| *E21B 33/134* | (2006.01) |
| *E21B 33/138* | (2006.01) |
| *E21B 47/00* | (2012.01) |

(52) U.S. Cl.

CPC ..... *E21B 33/14* (2013.01); *E21B 43/16* (2013.01); *E21B 33/134* (2013.01); *E21B 33/138* (2013.01); *E21B 47/0005* (2013.01)

(58) Field of Classification Search

CPC ..... E21B 33/14; E21B 33/134; E21B 33/138; E21B 47/0005

USPC ..... 166/285

See application file for complete search history.

(56) References Cited

U.S. PATENT DOCUMENTS

| | | | | |
|---|---|---|---|---|
| 6,443,245 | B2 * | 9/2002 | Michael | C08K 7/08 175/71 |
| 9,249,646 | B2 | 2/2016 | Hannegan et al. | |
| 2003/0106686 | A1 * | 6/2003 | Ingle | E21B 43/006 166/245 |
| 2006/0016599 | A1 * | 1/2006 | Badalamenti | E21B 33/14 166/285 |
| 2013/0118752 | A1 * | 5/2013 | Hannegan | E21B 47/0005 166/336 |
| 2014/0238665 | A1 | 8/2014 | Welker | |
| 2016/0053542 | A1 * | 2/2016 | Stafford | E21B 7/00 175/69 |

* cited by examiner

*Primary Examiner* — Silvana C Runyan
(74) *Attorney, Agent, or Firm* — Conley Rose, P.C.

(57) ABSTRACT

A method for cementing a tubular member within a subterranean wellbore extending from a surface into a subterranean formation and through a hydrocarbon reservoir includes (a) injecting a gas from the surface into an annulus surrounding the tubular member within the wellbore. In addition, the method includes (b) flowing cement through a throughbore of the tubular member. Further, the method includes (c) displacing the cement from the throughbore of the tubular member into the annulus. Still further, the method includes (d) reducing a pressure of the gas in the annulus during (c).

18 Claims, 8 Drawing Sheets

METHODS FOR CEMENTING A SUBTERRANEAN WELLBORE

CROSS-REFERENCE TO RELATED APPLICATIONS

This application claims benefit of U.S. provisional patent application Ser. No. 62/378,781 filed Aug. 24, 2016, and entitled "Methods for Cementing a Subterranean Wellbore," which is hereby incorporated herein by reference in its entirety.

STATEMENT REGARDING FEDERALLY SPONSORED RESEARCH OR DEVELOPMENT

Not applicable.

BACKGROUND

This disclosure relates generally to wellbore cementing operations. In particular, this disclosure relates to methods for more effectively drawing cement up an annulus toward the surface during wellbore cementing operations.

In drilling a borehole (or wellbore) into the earth for the recovery of hydrocarbons from a subsurface formation, it is conventional practice to connect a drill bit to the lower end of a tubular conduit (e.g., drill string, coiled tubing, etc.). The drill bit is then rotated either alone or along with the tubular conduit as weight-on-bit (WOB) is applied to engage the formation and drill the borehole along a predetermined path. As the borehole extends deeper within the subterranean formation, casing is inserted into the borehole to line the borehole, to provide additional structural reinforcement for borehole (i.e., to prevent collapse of the borehole wall), to prevent undesired outflow of drilling fluid into the formation or inflow of fluid from the formation into the borehole, and to prevent cross-flow between different formations via the borehole.

To secure the casing in position within the borehole, cement is pumped down the casing, and allowed to flow back up the annulus between the casing and the borehole sidewall. The cement is then allowed to set and cure, thereby securing the casing in position within the borehole.

BRIEF SUMMARY OF THE DISCLOSURE

Embodiments of methods for cementing a tubular member within a subterranean wellbore extending from a surface into a subterranean formation and through a hydrocarbon reservoir are disclosed herein. In some embodiments, the method comprises (a) injecting a gas from the surface into an annulus surrounding the tubular member within the wellbore. In addition, the method comprises (b) flowing cement through a throughbore of the tubular member. Further, the method comprises (c) displacing the cement from the throughbore of the tubular member into the annulus. Still further, the method comprises (d) reducing a pressure of the gas in the annulus during (c).

Other embodiments disclosed herein are directed to a method for cementing a tubular member within a subterranean wellbore extending from the surface into a subterranean formation and through a hydrocarbon reservoir. In an embodiment, the method comprises (a) injecting a gas from the surface into an annulus surrounding the tubular member within the wellbore. In addition, the method comprises (b) pressurizing the gas in the annulus to push a fluid in the annulus downhole to a predetermined depth in the annulus.

Further, the method comprises (c) flowing cement into a throughbore of the tubular member after (a). Still further, the method comprises (c) displacing the cement from the throughbore of the tubular member into the annulus. The method also comprises (d) bleeding the gas from the annulus during (c).

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION OF EXEMPLARY EMBODIMENTS

Figure 1:
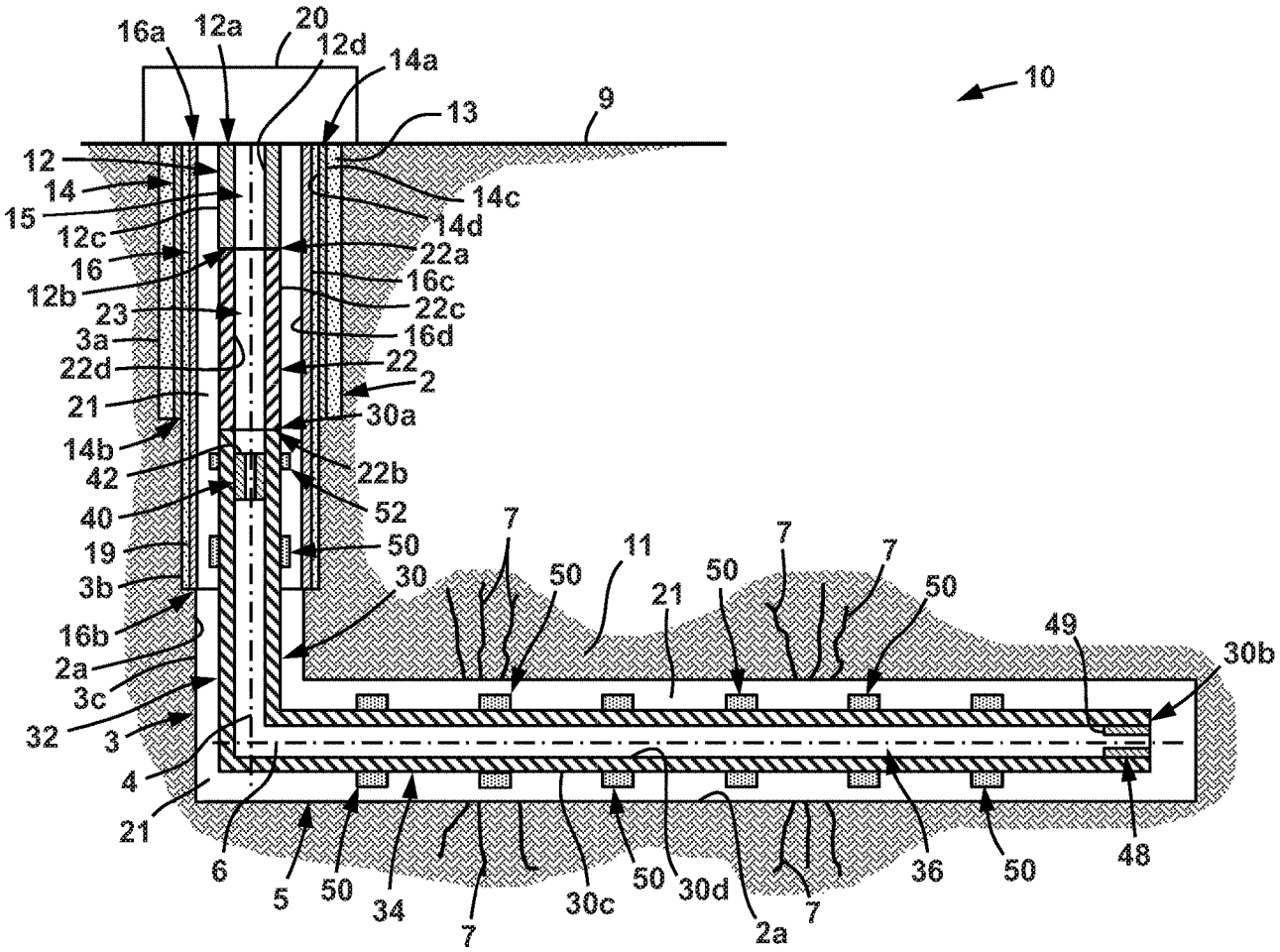
FIG. 1 is a schematic cross-sectional view of an embodiment of a system for producing hydrocarbons from a subterranean wellbore in accordance with the principles disclosed herein.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees. As used herein, the terms "fluid" and "fluids" refer to either a gas or liquid, or combinations thereof.

As previously described, during a typical cementing operation liquid (or semi-liquid) cement is pumped down the casing extending through the borehole, and is then directed up the annulus between the casing and the borehole sidewall. Cementing operations in wellbores extending through formations containing fractures (e.g., natural fractures, faults, cracks, fractures caused by hydraulic fracturing, etc.) are more complex as some of the cement flowing up the annulus may be lost into the surrounding formation (i.e., flows from the annulus through the fractures into the surrounding formation). In such formations, to ensure the cement continues to flow up the annulus toward the surface (e.g., to minimize losses of cement into the formation via the fractures), the pressure of the cement (or displacement fluid displacing the cement) may be increased. However, in fractured formations with relatively low reservoir pressures, an increase in the pressure of the cement may result in additional loss of cement to the surrounding formation. Further, if the pressure of the cement is increased beyond the formation fracture pressure, the cementing operation may result in undesirable additional fracturing of the formation. However, embodiments of systems and methods described herein are specifically designed and configured to manage pressures in the annulus to offer the potential to facilitate flow of cement through the annulus to the desired depth while simultaneously reducing the likelihood of inadvertently fracturing the formation and/or losing excessive cement volume to the formation. As will be explained in more detail below, embodiments described herein include injecting a pressurized gas into the annulus being cemented to set and control the pressure within the annulus. As cement is pumped into the annulus, the pressurized gas is bled from the annulus so that the pressure therein can be more precisely and carefully controlled (e.g., reduced) to allow the cement to be more effectively circulated up the annulus toward the surface. Through use of systems and methods described herein, the amount of cement lost to the formation, and the formation of additional fractures in the formation during a cementing operation may be minimized or even avoided.

Referring now to FIG. 1, an embodiment of a system 10 for producing hydrocarbons from a subterranean formation 11 via a wellbore 2 that extends through the formation 11 is shown. In this embodiment, system 10 generally includes a wellhead or other surface equipment 20 at the surface 9, a primary conductor or surface casing 14 extending from the surface 9 downhole through wellbore 2, and an intermediate casing 16 extending from the surface 9 downhole through surface casing 14 and wellbore 2. In addition, system 10 includes a tubular string 12 extending from the surface 9 through intermediate casing 16. A setting tool 22 is disposed on a lower end of tubular string 12, and a production liner 30 is coupled to and extends from setting tool 22 through wellbore 2. It should be appreciated that in at least some embodiments, the setting tool 22 is omitted, and the production liner 30 may be disposed on the end of some other tubular member (e.g., a casing pipe, tubular string, etc.). The production liner 30 may also be referred to as a production long string or production string.

Referring still to FIG. 1, wellbore 2 includes a vertical section 3 and a lateral section 5 extending from vertical section 3. A heel or bend is provided along wellbore 2 at the transition between sections 3, 5. Vertical section 3 has a substantially vertically oriented central axis 4 and horizontal section 5 has a substantially horizontally oriented central axis 6. However, in other embodiments, the central axis of the vertical section (e.g., axis 4 of vertical section 3) may be oriented +/−45° from vertical, and the central axis of the horizontal section (e.g., axis 6 of horizontal section 5) may be oriented +/−45° from horizontal. Wellbore 2 includes an inner sidewall 2*a* that extends along and defines both sections 3, 5 of wellbore 2. In general, the diameter of each section 3, 5 defined by sidewall 2*a* can be uniform or variable. In this embodiment, the diameter of vertical section 3 varies along it length. In particular, vertical section 3 includes a first or upper portion 3*a* extending from surface 9, a second or intermediate portion 3*b* extending from upper portion 3*a*, and a third or lower portion 3*c* extending from intermediate portion 3*b*. The diameter of upper portion 3*a* is larger than the diameters of both intermediate portion 3*b* and lower portion 3*c*, and the diameter of intermediate portion 3*b* is larger than the diameter of lower portion 3*c*. In this embodiment, the diameter of lateral section 5 is substantially the same as the diameter of lower portion 3*c*.

A plurality of fractures 7 extend through subterranean formation 11 and intersect lateral section 5 of wellbore 2. In general, fractures 7 may result from natural geologic processes, drilling of wellbore 2, a hydraulic fracturing operation, other downhole operation(s), or combinations thereof. The fractures 7 enhance access to a hydrocarbon reservoir (e.g., natural gas reservoir) in formation 11 through which lateral section 5 extends. Due to the general horizontal orientation of lateral section 5 and fluid communication along section 5 with the surrounding reservoir via fractures 7, the fluid pressure within lateral section 5 is substantially constant along its length and is substantially equalized with the pore pressure of the surrounding reservoir, also referred to herein as the "reservoir pressure." While not specifically shown, it should be appreciated that similar fractures 7 may intersect with vertical section 3 of wellbore 2.

Surface casing 14 and intermediate casing 16 are tubular members that extend downhole from surface 9 into vertical section 3 of wellbore 2. Specifically, surface casing 14 and intermediate casing 16 include a first or upper end 14*a*, 16*a*, respectively, and a second or lower end 14*b*, 16*b*, respectively. In this embodiment, upper ends 14*a*, 16*a* of casings 14, 16, respectively, are aligned with one another at (or proximate to) surface 9. However, it should be appreciated that one or both of casings 14, 16 may not extend all the way from surface 9 in other embodiments. For example, in some embodiments, surface casing 14 may extending from surface 9 (or proximate surface 9) such that upper end 14*a* is disposed at (or proximate to) surface 9, and intermediate casing 16 is disposed within surface casing 14 and extends from some point within vertical section 3 of wellbore 2 that is spaced from surface 9 such that upper end 16*a* is disposed at some point below upper end 14*a* and surface 9. In either case, lower end 16*b* of intermediate casing 16 is disposed below lower end 14*b* of surface casing 14. In addition, each casing 14, 16 includes a radially outer surface 14*c*, 16*c*, respectively, and a radially inner surface 14*d*, 16*d*, respectively. Surface casing 14 is disposed within upper portion 3*a* of vertical section 3 of wellbore 2, and intermediate casing 16 is disposed both within surface casing 14 and within intermediate portion 3*b*. Upper portion 3*a* of vertical section 3 has an inner diameter that is larger than an outer diameter of surface casing 14 such that an annulus 13 is formed radially between radially outer surface 14*c* and the inner wall 2*a* of wellbore 2. In addition, both casing 14 and intermediate portion 3*b* of vertical section 3 of wellbore 2 have an inner diameter that is larger than an outer diameter of intermediate casing 16 such that when intermediate casing 16 is installed within surface casing 14 and intermediate portion 3*b*, an annulus 19 is formed between the radially outer surface 16*c* of intermediate casing 16 and radially inner surface 14*d* of surface casing 14 and wellbore wall 2*a* within intermediate portion 3*b*. In this embodiment, each of the annuli 13, 19 are filled with cement to, among other things, secure casings 14, 16 within vertical section 3 of wellbore 2, to prevent the flow of fluids between inner wall 2*a* of wellbore 2 and casings 14, 16, and to prevent the flow of fluids between casings 14, 16.

Referring still to FIG. 1, tubular string 12 is inserted within intermediate casing 16. Tubular string 12 includes a first or upper end 12*a* disposed at (or proximate to) surface 9, a second or lower end 12*b* disposed within intermediate casing 16, a radially outer surface 12*c* extending between ends 12*a*, 12*b*, and a radially inner surface 12*d* extending between ends 12*a*, 12*b*. Radially inner surface 12*d* forms or defines a throughbore 15 extending between ends 12*a*, 12*b*.

Setting tool 22 is a tubular member inserted within intermediate casing 16 and mounted to tubular string 12. Setting tool 22 includes a first or upper end 22*a* coupled to lower end 12*b* of tubular string 12, a second or lower end 22*b* disposed within intermediate casing 16, a radially outer surface 22*c* extending between ends 22*a*, 22*b*, and a radially inner surface 22*d* also extending between ends 22*a*, 22*b*. Radially inner surface 22*d* forms or defines a throughbore 23 extending between ends 22*a*, 22*b*.

Production liner 30 is an elongate tubular member including a first or upper end 30*a* coupled to the lower end 22*b* of setting tool 22, a second or lower end 30*b* opposite upper end 30*a*, a first or vertical section 32 extending from upper end 30*a*, and a second or lateral section 34 extending from vertical section 32 to lower end 30*b*. Vertical section 32 of production liner 30 is disposed within vertical section 3 of wellbore 2 and lateral section 34 of production liner 30 is disposed within lateral section 5 of wellbore 2. In addition, vertical section 32 and lateral section 34 are generally coaxially aligned with vertical section 3 and lateral section 5, respectively, of wellbore 2. As a result, in at least some embodiments, vertical section 32 may extend within +/−45° of the vertical direction and lateral section 34 may be angled between 0° and 180° relative to vertical section 32. However, it should be appreciated that in some embodiments, one or more of the portions (e.g., portions 3*a*, 3*b*, 3*c*) of vertical section 3 of wellbore 2 may extend along a direction that is approximately +/−60°, 90°, or more from the vertical direction. Further, production liner 30 includes a radially outer surface 30*c* extending between ends 30*a*, 30*b*, and a radially inner surface 30*d* also extending axially between ends 30*a*, 30*b*. Radially inner surface 30*d* defines a throughbore 36 extending between ends 30*a*, 30*b*. Throughbores 15, 23, 36 are contiguous and in direct fluid communication. As shown in FIG. 1, upper end 30*a* is coupled to lower end 22*b* of setting tool 22 and upper end 22*a* of setting tool 22 is coupled to lower end 12*b* of tubular string 12 such that production liner 30 is suspended from setting tool 22 and tubular string 12 (at least initially).

The inner diameter of intermediate casing 16 is larger than the outer diameters of tubular string 12, setting tool 22, and production liner 30, and the outer diameter of production liner 30 is smaller than the inner diameter of lower portion 3*c* of vertical section 3 and lateral section 5 of wellbore 2. As a result, an annulus 21 is formed radially between tubular string 12 and intermediate casing 16, radially between setting tool 22 and intermediate casing 16, radially between production liner 30 and intermediate casing 16, and radially between production liner 30 and sidewall 2*a* along lower portion 3*c* of vertical section 3 and lateral section 5. Thus, in this embodiment, annulus 21 extends from surface 9 through to the lowermost end of wellbore 2 (i.e., within lateral section 5).

Referring still to FIG. 1, a liner wiper plug 40 is disposed within throughbore 36 of production liner 30 proximate upper end 30*a*. Liner wiper plug 40 sealingly engages inner surface 30*d* and includes an axial throughbore including a dart seat 42. Thus, fluid flowing through throughbores 15, 23, 36 flows through the open throughbore of liner wiper plug 40. As will be described in more detail below, during cementing operations, a dart (e.g., dart 44) is passed down throughbores 15, 23, 36 until it seats against and sealing engages dart seat 42, thereby preventing fluid flow through wiper plug 40. Thereafter, liner wiper plug 40 and the dart seated therein move together downhole within throughbore 36 toward lower end 30*b* of production liner 30. In addition, a bump plug 48 is disposed within throughbore 36 at lower end 30*b* of production liner 30. Bump plug 48 includes an axial throughbore and a plug seat 49 that engages liner wiper plug 40 during cementing operations described in more detail below.

Referring still to FIG. 1, in this embodiment, a plurality of open hole (OH) packers 50 are disposed about production liner 30. At least one of the OH packers 50 is disposed about outer surface 30*c* along vertical section 32, and a plurality of the OH packers 50 are disposed about outer surface 30*c* along lateral section 34. Each of the OH packers 50 is hydraulically actuated such that it can be selectively radially expanded into sealing engagement with the outer surface 30*c* of production liner 30 and the inner wall 2*a* of wellbore 2 (or the radially inner surface 16*d* of intermediate casing 16 for the OH packer 50 disposed about vertical section 32 of production liner 30 in FIG. 1). For example, in this embodiment, OH packers 50 are actuated by increasing the fluid pressure within throughbores 15, 23, 36 above a predetermined pressure threshold. When actuated, the OH packers 50 divide and separate annulus 21 into a plurality of fluidly isolated, axially adjacent portions or sections. It should be appreciated however, that some embodiments may not include packers 50.

A liner top packer 52 is disposed about production liner 30 at (or proximate to) upper end 30*a* and setting tool 22. Liner top packer 52 can be selectively actuated hydraulically, mechanically, or by any other actuation method known in the art. Similarl to OH packers 50, when liner top packer 52 is actuated, it expands radially outward into sealing engagement with the radially outer surface 30*c* of production liner 30 and the radially inner surface 16*d* of intermediate casing 16.

Referring now to FIGS. 2-7, a method for performing a cementing operation utilizing system 10 is schematically shown in sequence. In FIGS. 2-7, production liner 30 is cemented within wellbore 2 prior to the initiation of production from wellbore 2 via liner 30. As will be described in more detail below, the fluid pressure within annulus 21 is controlled during the cementing operation illustrated in FIGS. 2-7 with a pressurized gas injected into the annulus 21 from the surface 9.

Figure 2:
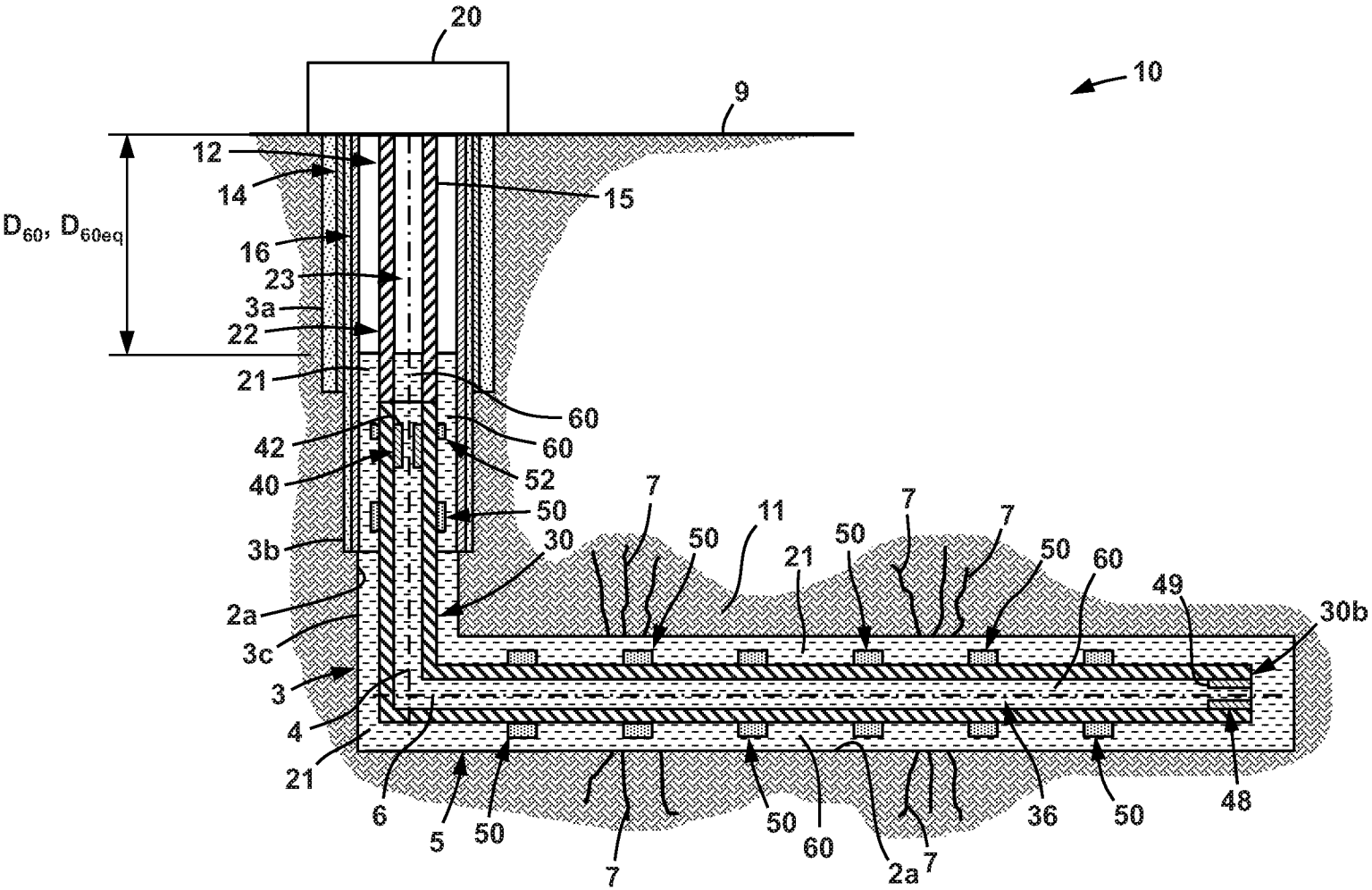
FIGS. 2-7 are sequential schematic cross-sectional views of an embodiment of a method for performing a cementing operation utilizing the system of FIG. 1 in accordance with the principles disclosed herein.

Referring first to FIG. 2, initially, throughbores 15, 23, 36 and annulus 21 are at least partially filled with fluid 60, which may be water or another fluid such as drilling mud. For example, fluid 60 may be water and/or drilling mud remaining in wellbore 2 following drilling and installation of casings 14, 16. The top of fluid 60 is disposed at a depth $D_{60}$ measured vertically from the surface 9 to the top of fluid 60. In FIG. 2, the depth $D_{60}$ is the depth of fluid 60 at equilibrium within wellbore 2 with the upper end of the annulus open to ambient surface pressure, and thus, is also identified with reference numeral $D_{60eq}$. As is known in the art, the vertical depth to which a fluid at equilibrium in a wellbore extends (e.g., depth $D_{60}$ of fluid 60) is a function of a variety of factors including, without limitation, the hydrostatic head of the fluid (depends on the weight/density of fluid 60 and the vertical height of the column of fluid 60 in vertical section 3), the reservoir pressure, and friction between the fluid and the surrounding structures (e.g., friction between fluid 60 and production liner 30 and sidewall 2*a*). Thus, the depth $D_{60}$ of fluid 60 in wellbore 2 can be used to determine (e.g., calculate) the reservoir pressure using techniques known in the art. Alternatively, the reservoir pressure can be more directly measured with a gauge lowered into lateral section 5 to measure the pressure therein, which is substantially equalized with the reservoir pressure as previously described.

As previously described, in many conventional wellbores, a cementing operation relies on over pressurization of the cement to flow the cement down a tubular string (e.g., a casing string or production string), out the lower end of the string, and up the annulus between the string and the borehole sidewall to the desired location along the annulus. However, in wellbores with extensive fractures extending therefrom into the formation, such as wellbore 2 and associated fractures 7 in formation 11, over pressurization of the cement may result in substantial loss of the cement into the surrounding formation via the fractures. In addition, in formations having relatively low fracture pressures, over pressurization of the cement may undesirably initiate new fractures and/or enhance existing fractures. Accordingly, over pressurization of the cement to drive it to the desired location in the annulus may not be a viable option in wellbores associated with extensive fractures and/or relatively low formation fracture pressures. Therefore, in embodiments disclosed herein, the formation fracture pressure is relied on to support circulation of cement in the annulus 21 and the reservoir pressure is relied on to push or circulate cement in the annulus 21 during the cementing operations. Using the reservoir pressure determined as previously described, the anticipated location to which the reservoir can push or circulate cement 64 (and fluid 60 disposed atop cement 64) within annulus 21 is determined (e.g., calculated). For relatively low reservoir pressures such as the reservoir surrounding lateral section 5, the reservoir pressure alone may be insufficient to circulate the cement to the desired location due to the hydrostatic head of fluids (e.g., fluid 60 and/or cement) in the vertical section 3. Accordingly, in embodiments described herein, a pressurized gas 62 is used to effectively reduce the hydrostatic head of fluids in the vertical section 3 to enhance the circulation of the cement at the reservoir pressure.

Figure 3:
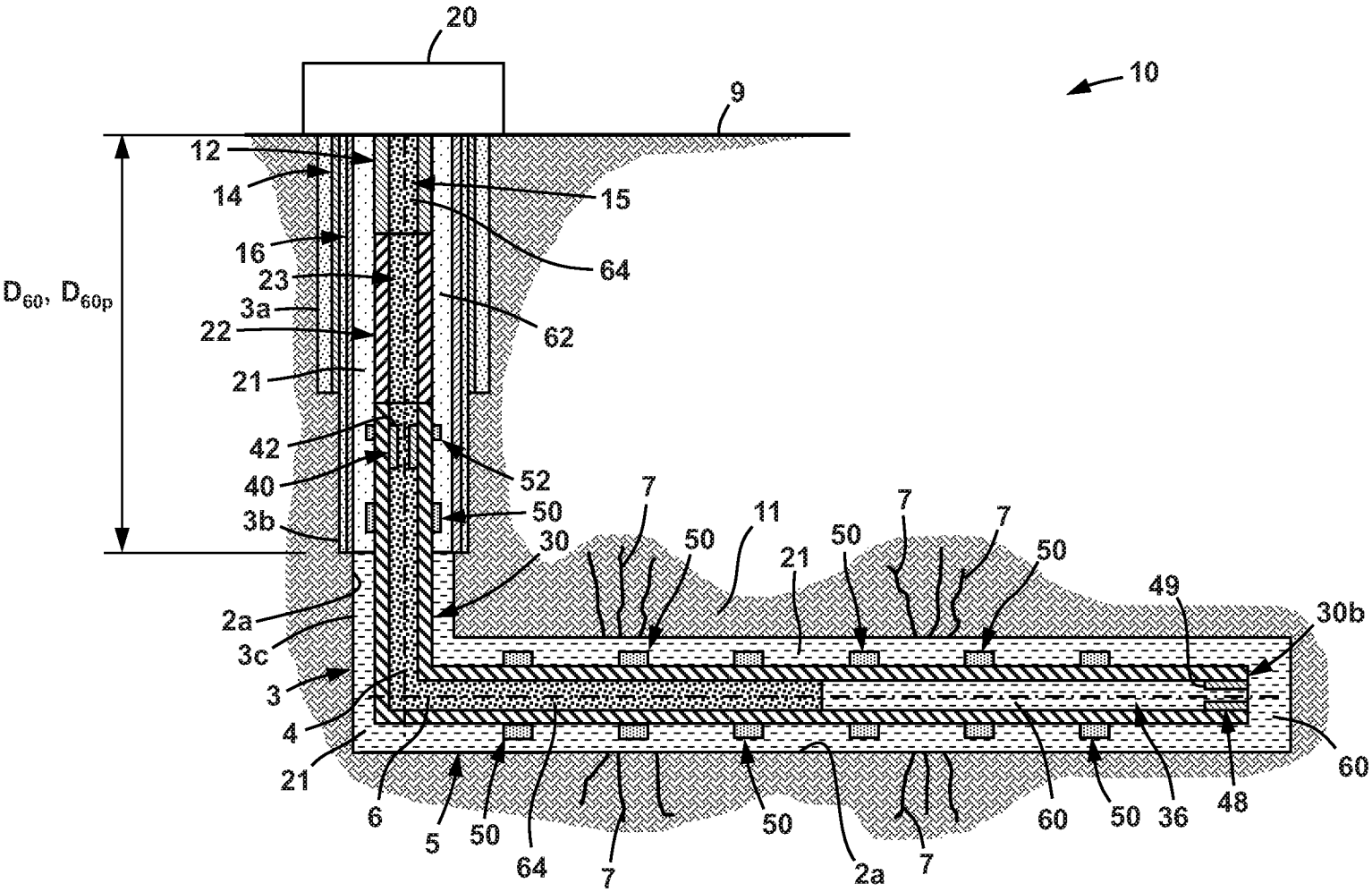

Moving now to FIG. 3, next, the pressurized gas 62 is injected into annulus 21 from the surface 9. In this embodiment, the gas 62 is injected directly into annulus 21 from the surface 9, and thus, is not injected into the throughbores 23, 36 and circulated back up annulus 21. In general, the gas 62 can be any suitable gas including, without limitation, nitrogen ($N_2$), carbon dioxide ($CO_2$), air, hydrocarbon gases (e.g., natural gas), or combinations thereof. In some embodiments, gas 62 is an inert gas to avoid an interaction (e.g., explosive, chemical, etc.) between the injected gas 62 and any other fluids (i.e., liquid or gas) (e.g., fluid 60) that may be present within the wellbore 2.

The injected gas 62 fills the open upper portion of annulus 21 above fluid 60. As gas 62 continues to be pumped into annulus 21, the pressure of gas 62 increases within annulus 21 (e.g., gas is pressurized within annulus 21) and begins to push fluid 60 in annulus 21 downward within vertical section 3, thereby effectively reducing the hydrostatic head of fluid 60 in annulus 21 along vertical section 3. The gas 62 in annulus 21 is injected and pressurized within annulus 21 to a predetermined pressure (measured at the surface) sufficient to push fluid 60 down to a predetermined depth $D_{60p}$. In other words, gas 62 is injected into annulus and pressurized within annulus 21 to the predetermine pressure necessary to fill annulus 21 with gas 62 to depth $D_{60p}$. As will be described in more detail below, the predetermined pressure of gas 62 and the corresponding predetermined depth $D_{60p}$ of fluid 60 is chosen to displace a sufficient volume of fluid 60 in annulus 21 and sufficiently reduce the hydrostatic head of fluid 60 in annulus 21 along vertical section 3 to allow for cement 64 supplied to annulus 21 at end 30*b* of liner 30 to be driven uphole within annulus 21 by the reservoir pressure to a desired or predetermined location within annulus 21 as the pressurized gas 62 is bled from annulus 21. It should be appreciated that at least a portion of the volume of fluid 60 in annulus 21 displaced by pressurized gas 62 may be pushed into formation 11 via fractures 7.

For most wellbores including lateral sections (e.g., wellbore 2 including lateral section 5), the cement preferably fills the annulus along at least the entire lateral section (e.g., from lower end 30*b* of liner 30 to the heel between sections 3, 5), and more preferably fills the annulus along the entire lateral section, the heel, and along the portion of the vertical section extending from the heel to the liner hanger (e.g., from lower end 30*b* of liner 30 to upper end 30*a* and setting tool 22). In this embodiment, the predetermined depth $D_{60p}$ is the depth to lower end 16*b* of intermediate casing 16. However, in other embodiments, gas 62 may be injected and pressurized in annulus 21 to push fluid 60 to other predetermined depths $D_{60p}$ depending on the desired, predetermined location of cement 64 and the associated reduction in the hydrostatic head of fluid 60 in annulus 21 along vertical section 3 necessary to achieve the desired, predetermined location of cement 64.

Still referring to FIG. 3, after gas 62 has been injected into annulus 21, cement 64 is pumped or otherwise flowed down throughbores 15, 23, 36, thereby displacing fluid 60 within liner 30 and pushing fluid 60 from throughbores 15, 23, 36 into the annulus 21 at lower end 30*b*. Annulus 21 is shut in at the surface 9 as cement 64 is pumped down throughbores 15, 23, 36 to lower end 30*b* of liner 30. Thus, as cement 64 flows to lower end 30*b*, the pressure of the gas 62 within the annulus 21 (as measured at the surface 9) and the depth $D_{60}$ of fluid 60 in the annulus 21 may fluctuate slightly up or down as fluid 60 is pushed from throughbores 23, 36 into annulus 21 by cement 64. During this process, some fluid 60 in annulus 21 may be forced into formation 11 via fractures 7 as cement 64 is pumped to lower end 30*b* of liner 30.

Figure 4:
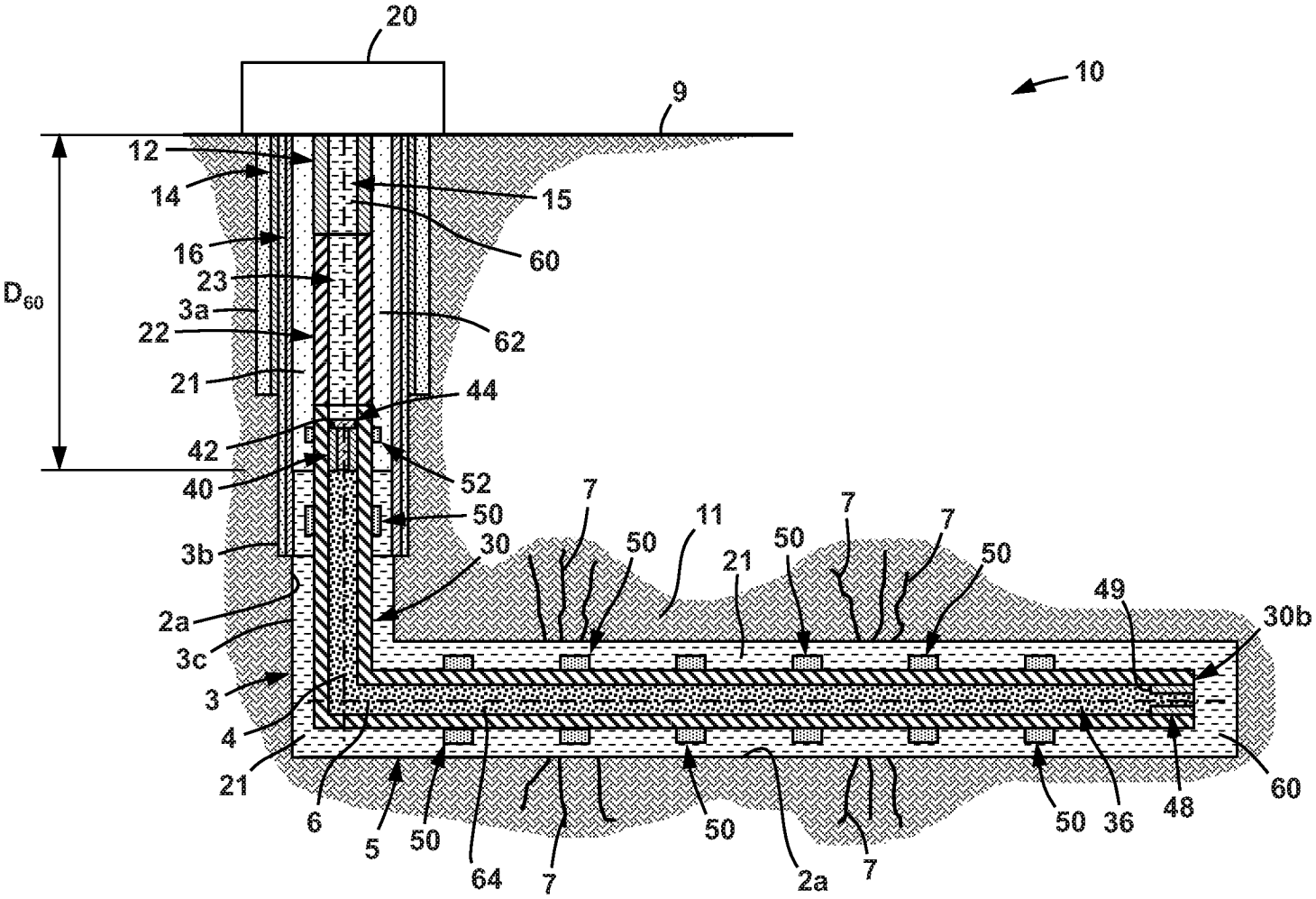

Referring now to FIG. 4, next, a dart 44 is pumped down throughbores 15, 23, 36 of tubular string 12, setting tool 22, and production liner 30, respectively, and into sealing engagement with dart seat 42 of liner wiper plug 40. In this embodiment, dart 44 is pumped down throughbores 15, 23, 36 to plug 40 with fluid 60. Sealing engagement of dart 44 and seat 42 closes the throughbore of plug 40 and prevents fluid (e.g., fluid 60, cement 64, etc.) from flowing past or around liner wiper plug 40 within throughbore 36.

Figure 5:
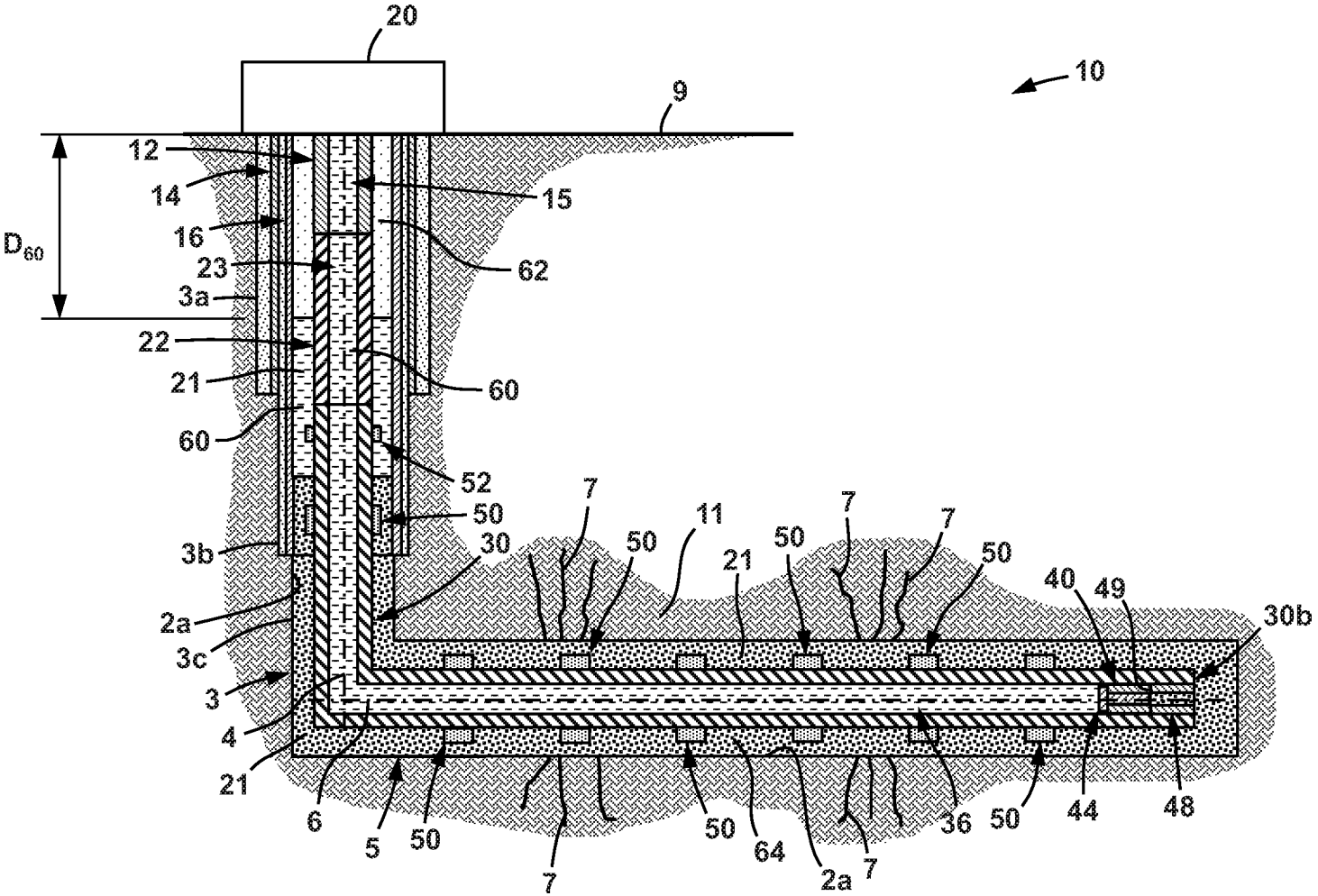
Figure 6:
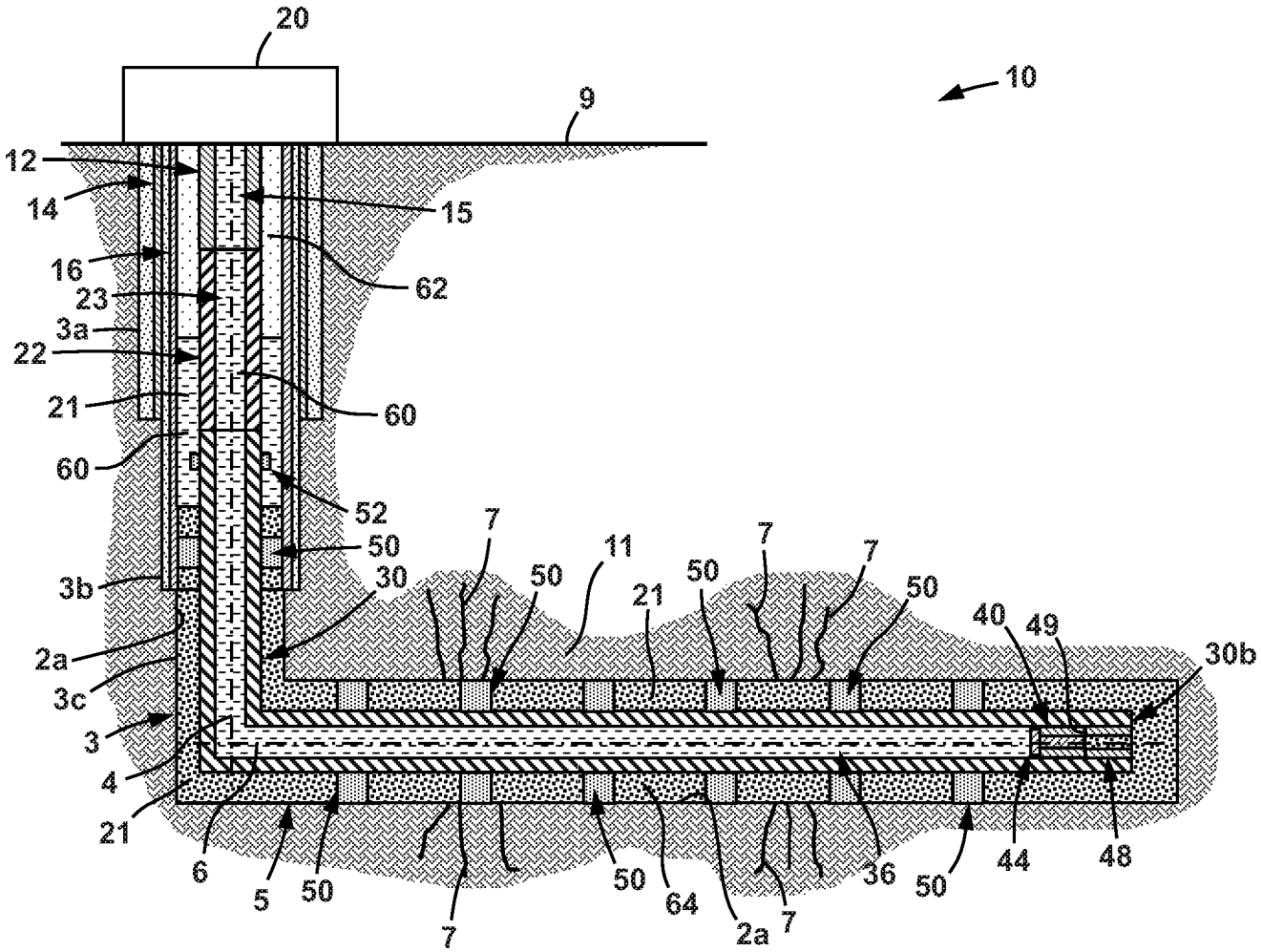

Moving now to FIGS. 5 and 6, once dart 44 engages seat 42, continued pumping of fluid 60 into throughbores 15, 23 from surface 9 causes the fluid pressure above plug 40 to increase until it is sufficient to drive plug 40 downward through throughbore 36 of production liner 30 toward lower end 30*b*. Because liner wiper plug 40 is sealingly engaged with radially inner surface 30*d* of production liner 30 and dart 44 closes the throughbore of plug 40, the cement 64 downhole of plug 40 is forced out of lower end 30*b* of production liner 30 and into annulus 21 as liner wiper plug 40 translates toward lower end 30*d*. As cement 64 flow uphole within annulus 21, pressurized gas 62 within annulus 21 is controllably bled off to controllably reduce the pressure of gas 62 within annulus 21. In this embodiment, the pressure of the gas 62 within annulus 21 is controllably reduced (e.g., bled off) once cement 64 begins to exit lower end 30*b* of production liner 30. In general, the pressure of gas 62 can be reduced gradually and/or continuously. However, gas 62 is preferably bled to controllably reduce its pressure within annulus 21 at a rate that ensures: (i) fluids in the formation 11 (e.g., fluid 60, formation fluids, etc.) do not enter the wellbore 2 and contaminate the cement 64 in annulus 21; and (ii) a substantial quantity of cement 64 in annulus 21 is not lost into the formation 11 (e.g., via fractures 7). It should be appreciated that if the rate of pressure reduction of gas 62 in annulus 21 is too fast, the fluid pressure in annulus 21 along lateral section 5 may undesirably decrease below the reservoir pressure and allow fluids in the formation 11 to enter annulus 21; and if the rate of pressure reduction of gas 62 in annulus 21 is too slow, the fluid pressure in annulus 21 along lateral section 5 may undesirably increase sufficiently above the reservoir pressure that a substantial quantity of cement 64 is lost into the formation 11 (e.g., via fractures 7). In this embodiment, the pressure of gas 62 in annulus 21 is preferably reduced at a rate that continuously ensures at least about 50 vol % of cement 64 injected into annulus 21 from lower end 30*b* of liner 30 is circulated through annulus 21, and more preferably reduced at a rate that continuously ensures at least about 80 vol % of cement 64 injected into annulus 21 from lower end 30*b* of liner 30 is circulated through annulus 21. In other words, the pressure of gas 62 in annulus 21 is preferably reduced at a rate that continuously ensures less than about 50 vol % of cement 64 is lost to formation 11, and more preferably less than about 20 vol % of cement 64 injected into annulus 21 from liner 30 is lost to formation 11.

In embodiments described herein, the cement 64 preferably fills the annulus 21 at least along the entire lateral section 5 (e.g., from lower end 30*b* of liner 30 to the heel between sections 3, 5), and more preferably fills the annulus 21 along the entire lateral section 5, along the heel, and along the portion of the vertical section 3 extending from the heel to lower end 30*b* of liner 30 to upper end 30*a* and setting tool 22. Thus, in embodiments described herein, the predetermined pressure of gas 62 and the predetermined depth $D_{60p}$ to which gas 62 displaces fluid 60 (at the predetermined pressure of gas 62) is preferably selected to allow the reservoir pressure to support circulation of cement 64 (and fluid 60) within annulus 21 to at least the heel between sections 3, 5, and more preferably to upper end 30*a* and setting tool 22 before the hydrostatic head of fluid (e.g., fluid 60 and/or cement 64) within annulus 21 along vertical section 3 is substantially balanced with the reservoir pressure.

As previously described, the desired, predetermined location of cement 64 in annulus 21 is used to determine the predetermined pressure of gas 62 and associated predetermined depth $D_{60p}$ of fluid 60 (FIG. 3). In general, the predetermined pressure of the injected gas 62 and predetermined depth $D_{60p}$ of fluid 60 can be determined using wellbore models and fluid dynamics principles known in the art, which consider a variety of factors including, without limitation, the reservoir pressure, the weight/density of the various fluids in the annulus 21 (e.g., fluid 60, cement 64, gas 60, etc.), and frictional loads between fluids in the annulus 21 and the surrounding structures. For example, if the depth $D_{60eq}$ of fluid 60 in annulus 21 along vertical section 3 at equilibrium is 1,000 feet (with the upper end of the annulus open to ambient surface pressure), it is understood that the reservoir pressure is strong enough to support a hydrostatic head of fluid 60 extending to the depth $D_{60eq}$ of 1,000 feet, but cannot support a hydrostatic head of fluid 60 extending to a height above than the 1,000 foot depth $D_{60eq}$ (assuming that the lowest pressure at the upper end of annulus 21 is the ambient surface pressure). Thus, if cement 64 is injected into annulus 21 at lower end 30*b* of liner 30 with fluid 60 at depth $D_{60eq}$ of 1,000 feet, the reservoir pressure is insufficient to support a hydrostatic head of fluid 60 above the 1,000 foot depth $D_{60eq}$ needed to circulate the cement 64 through the annulus 21. As a result, a substantial amount of the injected cement 64 and/or fluid 60 will be exit the annulus 21 via fractures 7. To enable the cement 64 to circulate through a 5,000 foot length of the lateral section 5 under reservoir pressure, without a substantial portion of the cement 64 or fluid 60 being lost to the formation via fractures 7, the reservoir pressure must be sufficient to support a 5,000 foot increase in the vertical height and associated hydrostatic head of the fluid 60 in vertical section 3. It is known that the reservoir pressure can support fluid 60 to the 1,000 foot depth $D_{60eq}$, and thus, gas 62 can be injected into annulus 21 and pressurized to push fluid 60 down vertical section 3 to a predetermined depth $D_{60p}$ of at least 6,000 feet, with the understanding that the reservoir pressure is sufficient to support an increase in the height of fluid 60 (and associated increase in hydrostatic head of fluid 60) from the 6,000 foot predetermined depth $D_{60p}$ back to the 1,000 foot equilibrium depth $D_{60eq}$ when pressurized gas 62 is bled to controllably reduce its pressure to ambient surface pressure. This effectively enables the reservoir pressure to support the circulation of fluid 60 to a height increase of about 5,000 feet, which in turn enables the circulation of the cement 64 through about a 5,000 foot length of the lateral section 5 with minimal loss of cement 64 into the formation via fractures 7. Thus, in this simplified example, the predetermined depth $D_{60p}$ of fluid 60 is 6,000 feet and the predetermined pressure of gas 62 is the pressure of gas 62 within annulus 21 at the surface 9 necessary to push fluid 60 to the predetermined depth $D_{60p}$ of 6,000 feet. It should be appreciated that in this simplified example, only fluid 60 contributes to the hydrostatic head in vertical section 3 (cement 64 is only circulated within lateral section 5), and thus, it is assumed cement 64 does not contribute to the hydrostatic head; the density of pressurized gas 62 in annulus 21 is ignored; and friction between fluid 60 and cement 64 with surrounding structures is ignored. In practice, a safety factor is preferably used to determine the predetermined depth $D_{60p}$ to account for potential fluid losses, as well as any other factors that could potentially limit the ability of the reservoir pressure to push fluid 60 back to the equilibrium depth $D_{60q}$ when the pressurized gas 62 is bled.

Moving now to FIGS. 5 and 6, liner wiper plug 40 and dart 44 are translated within throughbore 36 toward lower end 30*b* until plug 40 and/or dart 44 engages plug seat 49 on bump plug 48. In this embodiment, liner wiper plug 40 and/or dart 44 sealingly engage with plug seat 49 on bump plug 48 such that fluid (e.g., flow of fluid 60, cement 64, etc.) is prevented from flowing across the engaged plugs 40, 48. In other embodiments, engagement between liner wiper plug 40 and/or dart 44 is such that fluid is merely restricted from flowing past the engaged plugs 40, 48. In either case, once plug 40 (and/or dart 44) and plug 48 are engaged at lower end 30*b* of production liner 30, continued pumping of fluid 60 into throughbores 15, 23, 36 from surface 9 increases the fluid pressure within throughbores 15, 23, 36 until OH packers 50 are actuated (i.e., packers 50 are actuated via the pressure increase within throughbore 36), thereby expanding OH packers 50 into sealing engagement with inner wall 2*a* of wellbore 2 (or radially inner surface 16*d* of intermediate casing 16 such as is the case for the OH packer 50 disposed within vertical section 3 as shown in FIGS. 5 and 6). In this embodiment, actuation of OH packers 50 is completed while the cement 64 disposed within annulus 21 is still liquid (or semi-liquid), so that the expanding packer elements of OH packers 50 may expand radially through the cement 64 and into engagement with inner wall 2*a* (or radially inner surface 16*d*) as previously described. Accordingly, after actuation of OH packers 50, annulus 21 is separated into a plurality of isolated sections, intervals, or regions. These isolated regions may be individually stimulated (e.g., perforated, hydraulically fractured, etc.) to allow production into throughbore 36 from a desired section of wellbore 2 (which may correspond to a desired region or portion of formation 11). In the event that one or more of the packers 50 should not properly and/or fully actuate upon increasing the fluid pressure within throughbores 15, 23, 36, subsequent remedial operations may be conducted to accomplish the actuation of the one or more packers 50.

Figure 7:
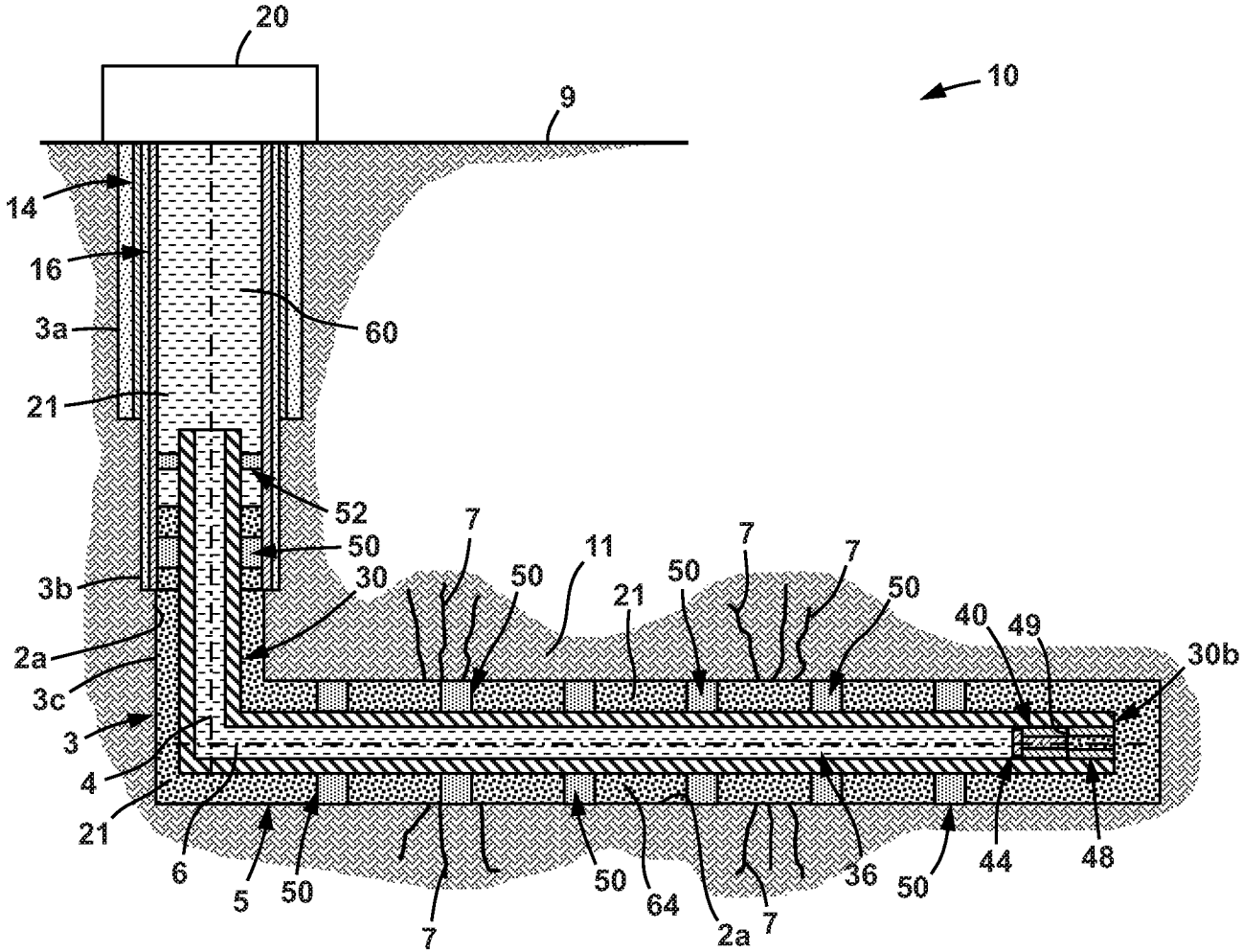

Referring now to FIG. 7, once OH packers 50 are actuated in the manner described above, liner top packer 52 is actuated (e.g., mechanically or hydraulically) so that it expands radially to sealingly engage with radially inner surface 16*d* of intermediate casing 16. Thereafter, setting tool 22 is decoupled from production liner 30 and pulled to the surface 9. For example, in some embodiments, setting tool 22 is coupled to production liner 30 with an actuatable connector (e.g., a hydraulically, mechanically, and/or pressure actuated connector) such that setting tool 22 may be remotely disconnected from production 30 from surface 9 when desired.

While embodiments disclosed herein include injecting a gas (e.g., gas 62) into the annulus disposed about the tubular string (e.g., annulus 21 about tubular string 12, setting tool 22, and production liner 30), it should be appreciated that liquids may be injected into the annulus 21 in other embodiments. In such embodiments, the injected liquid is chosen such that it is generally lighter (e.g., has a lower density, lower specific gravity, etc.) than the other fluids disposed within the wellbore 2 (e.g., fluids 60). For example, in at least some embodiments, water is injected into the annulus 21, which may also contain drilling mud or some other relatively heavy fluid (i.e., fluid 60 would comprise drilling mud or some other relatively heavy fluid in these embodiments). Then the pressure of the injected water is then controllably reduced (e.g., gradually and/or continuously) as cement is produced out of the shoe (e.g., lower end 30*b*) of production liner 30 in substantially the same way as described above (such that these details are omitted in the interests of brevity). Thus, in the same manner as described above, by controllably reducing the pressure of the water previously injected within annulus 21 during cementing operations, the cement may be more effectively drawn up within the annulus 21 toward the surface 9 (thereby minimizing the amount of cement that flows into the formation via fractures 7).

Figure 8:
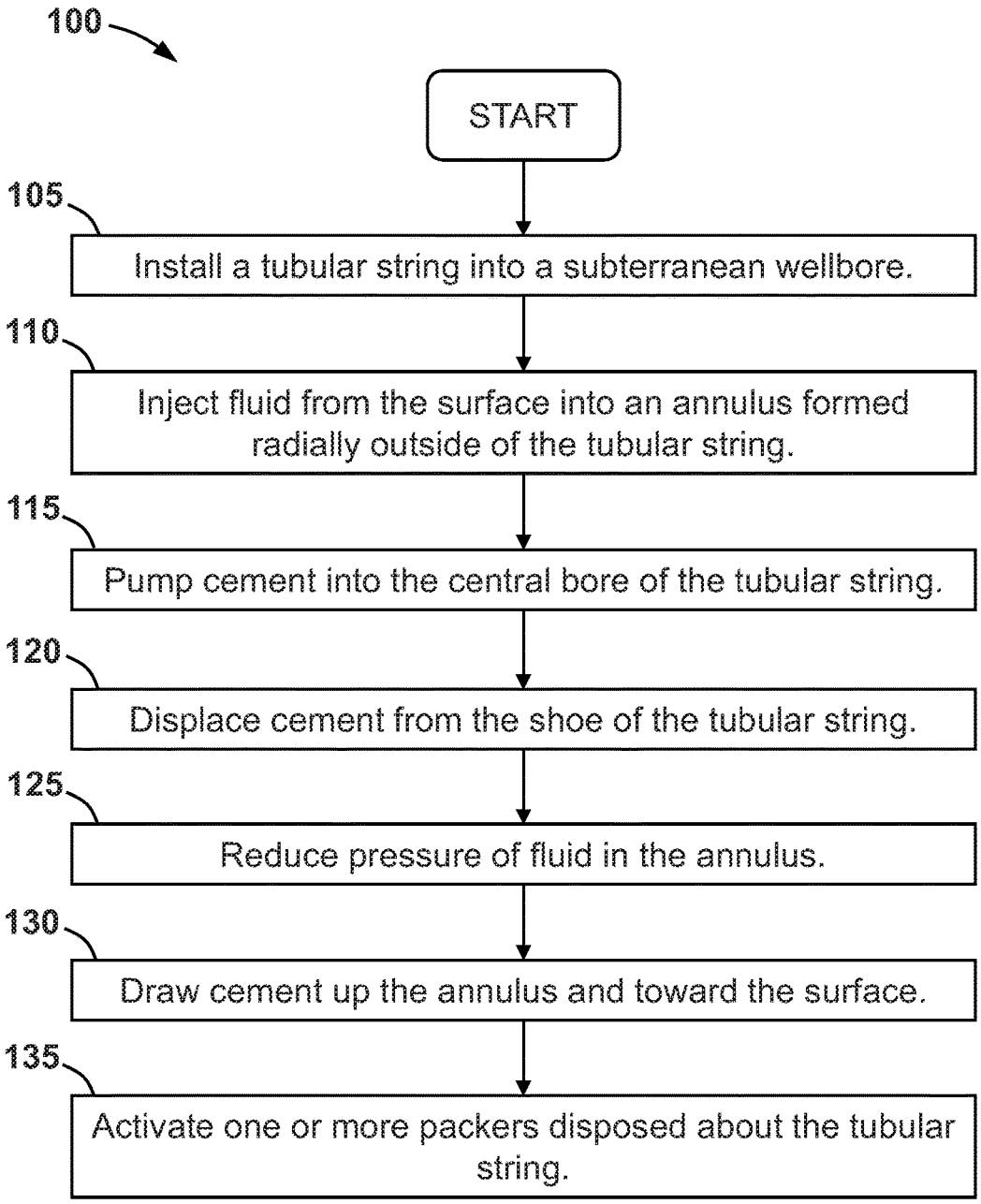
FIG. 8 is a block diagram of an embodiment of a method for performing a cementing operation in accordance with the principles disclosed herein.

Referring now to FIG. 8, a method 100 for performing a cementing operation in a subterranean well is shown. In this embodiment, method 100 is performed using system 10 previously described, however, in other embodiments, method 100 can be performed with other systems. Accordingly, any reference to system 10 or components thereof is only meant to facilitate the description of method 100 and is not meant to limit application of method 100 to system 10 alone.

Starting at block 105, method 100 includes installing a tubular string (e.g., tubular string 12, setting tool 22, and/or production liner 30) into a subterranean wellbore (e.g., wellbore 2). In some embodiments, at least a portion of the tubular string may comprise a production liner (e.g., production liner 30). Some of these embodiments may insert at least a portion of the production liner of the tubular string into a lateral section (or substantially lateral section) (e.g., lateral section 5) of the wellbore. In others of these embodiments, method 100 includes inserting the production liner (or at least a portion thereof) of the tubular string into a vertical section (or substantially vertical section) (e.g., vertical section 3) of the wellbore. In still others of these embodiments, method 100 includes inserting a portion of the production liner of the tubular string into a vertical section (or substantially vertical section) of the wellbore, and inserting another portion of the production liner into a lateral section (or substantially lateral section) of the wellbore.

Next, method 100 includes injecting a fluid into an annulus (e.g., annulus 21) formed radially outside (i.e., about) the tubular string at block 110. In some embodiments, the injected fluid comprises a gas (e.g., $N_2$, $CO_2$, natural gas, etc.) (e.g., gas 62), while in other embodiments, the injected fluid comprises a liquid (e.g., water, brine, sodium chloride, potassium chloride, etc.). In addition, in some embodiments, the annulus is formed radially between the tubular string and another tubular (e.g., intermediate casing 16) and/or between the tubular string and the inner wall (e.g., inner wall 2*a*) of the wellbore 2. The fluid (e.g., gas and/or liquid) may be injected from the surface (e.g., surface 9) directly into the annulus so that it fills (or substantially fills) the annulus to a predetermined depth. The injected fluid may be pressurized to a predetermined pressure to achieve the predetermined depth. The predetermined depth and associated predetermined pressure of the injected fluid may be set to result in a desired hydrostatic head reduction within the well sufficient to allow the reservoir pressure to support circulation of cement to a desired location along the annulus of the wellbore. In at least some embodiments, the fluid injected at 110 may be an inert gas such as nitrogen gas ($N_2$) to avoid an interaction (e.g., explosive, chemical, etc.) between the injected gas and any other fluids (i.e., liquid or gas) (e.g., fluid 60) that may be present within the wellbore.

Moving now to block 115, method 100 includes pumping or flowing cement (e.g., cement 64) into the throughbore (e.g., throughbores 15, 23, 36, etc.) of the tubular string. During this process, cement may be injected and/or pumped into the tubular string such that water or other fluids (e.g., fluid 60) within the tubular string may at least be partially displaced therefrom into the annulus (e.g., annulus 21) and formation (e.g., formation 11). Once a desired amount of cement is pumped into the tubular string (e.g., sufficient cement to fill a desired portion of the annulus), pumping of the cement is ceased. Then, at block 120, the cement is displaced from the shoe of the tubular string (e.g., lower end 30*b* of production liner 30) and into the annulus. Displacement of the cement may be accomplished in a number of different fashions. For example, in some embodiments, a displacement fluid (e.g., fluid 60) may be pumped into the central bore of the tubular string to flush the cement out of the shoe of the tubular string and into the annulus. As another example, in other embodiments, a dart (e.g., dart 44) may be dropped or pumped downhole until it engages with a seat (e.g., seat 42) on the wiper plug (e.g., liner wiper plug 40). Thereafter, a displacement fluid (e.g., fluid 60) may be pumped into the central bore of the tubular string above the engaged dart and wiper plug to cause wiper plug to traverse within the tubular string toward the shoe at the distal or lower end thereof (e.g., lower end 30*b*). The sliding and potentially sealing engagement between the wiper plug and the inner surface (e.g., radially inner surface 30*d*) of the tubular string effectively sweeps the cement from tubular string and into the annulus.

Referring still to FIG. 8, at block 125, either after, just after, or simultaneously with displacing the cement from the shoe of the tubular string at 120, method 100 includes reducing the pressure of the fluid previously injected into the annulus. Specifically, the fluid (e.g., gas and/or liquid) may be emitted, bled, flowed out of the annulus at surface so that the volume and pressure of the previously injected fluid is reduced. The pressure may be gradually and/or continuously reduced such that a desired amount of pressure is maintained within the annulus during displacement of the cement into the annulus to allow circulation of cement through the annulus, rather than into one or more fractures (e.g., natural, un-natural fractures, etc.) (e.g., fractures 7) in the formation that intersect with the wellbore. In other words, the reduction in the fluid pressure is set, designed, and/or configured, to maintain sufficient pressure within the wellbore to prevent formation fluids from entering the wellbore from the formation, but also to ensure that the path of least resistance for the cement is up the annulus and toward the surface. As a result method 100 also includes drawing cement into the annulus and toward the surface at 130.

Method 100 also includes activating one or more packers (e.g., OH packers 50, liner top packer 52, etc.) disposed about the tubular string at block 135. In some embodiments, activating the packers at 135 takes place soon (or relatively soon) after drawing the cement up the annulus 130 such that the expanding packing elements may still expand through liquid or semi-liquid cement. Once the packers about the tubular string are actuated, one or more intervals are defined therebetween that may then be individually stimulated (e.g., via perforation, hydraulic fracturing, etc.) so that formation fluids may be produced from the formation into the wellbore.

In the manner described, embodiments of systems and methods for performing cementing operation in a wellbore extending into a subterranean formation in accordance with the principles disclosed herein (e.g., system 10, method 100) offer the potential to reduce the potential for cement to flow into fractures (e.g., fractures 7) extending through the formation and intersecting the wellbore (e.g., wellbore 2). As a result, less cement is used during cementing operation, and cement is better distributed through the annulus being cemented (e.g., annulus 21). In addition, embodiments of systems and methods in accordance with the principles disclosed herein offer the potential to maintain fluid pressure within the wellbore at a sufficient level to prevent and/or minimize the influx of formation fluids into the wellbore during cementing operations (thereby limiting cement contamination), and also avoiding the creation of new fractures or lost circulation to the formation during a cementing operation. Thus, embodiments of systems and methods disclosed herein may be particularly useful for formations that are heavily fractured and/or have a relatively low formation fracture pressure.

While embodiments disclosed herein include systems and methods for performing cementing operation in a wellbore located at a land-based location, it should be appreciated that other embodiments of system 10 and method 100 may be utilized for a wellbore disposed at an offshore location (i.e., an offshore well). In addition, while embodiments disclosed herein have included a dart (e.g., 44) for engaging with a seat on a liner wiper plug (e.g., wiper plug), it should be appreciated that other embodiments may utilize another type of droppable or pumpable actuation device, such as, for example, a single wiper plug (e.g., in place of liner wiper plug 40), a ball, plunger, etc. For example, some embodiments may employ a wiper plug pumped from the surface 9 through setting tool 22 and production liner 30 in place of liner wiper plug 40, to displace cement 64 into annulus 21 during operations. Further, while embodiments disclosed herein have only shown casings 14, 16, it should be appreciated that other embodiments may employ additional or fewer intermediate casing strings (or liners).

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for cementing a tubular member within a subterranean wellbore extending from a surface into a subterranean formation and through a hydrocarbon reservoir, the method comprising:

(a) injecting a gas from the surface into an annulus surrounding the tubular member within the wellbore;

(b) flowing cement through a throughbore of the tubular member;

(c) displacing the cement from the throughbore of the tubular member into the annulus; and (d) reducing a pressure of the gas in the annulus during (c), wherein (d) further comprises:

(d1) maintaining a fluid pressure in the annulus equal to or greater than a reservoir pressure of the reservoir; and (d2) limiting the loss of cement into the subterranean formation to less than about 20 vol %.

2. The method of claim 1, further comprising:

(e) displacing a portion of a fluid in the annulus downhole of the gas during (a).

3. The method of claim 1, wherein (a) comprises pressurizing the gas in the annulus to push the gas to a predetermined depth in the annulus.

4. The method of claim 3, further comprising:

(e) flowing the cement uphole through the annulus to a predetermined location in the annulus during (d), wherein the predetermined depth is based on the predetermined location.

5. The method of claim 1, wherein the gas injected from the surface into the annulus is an inert gas.

6. The method of claim 5, wherein the gas injected from the surface into the annulus is nitrogen gas.

7. The method of claim 1, wherein (c) comprises:

(c1) closing a flow path through a plug disposed within the throughbore of the tubular member;

(c2) pumping fluid into the throughbore uphole of the plug after (c1); and (c3) pushing the plug toward a lower end of the tubular member during (c2) with the fluid.

8. The method of claim 7, wherein (c1) comprises:

flowing a dart within the throughbore of the tubular member; and engaging the dart with a dart seat on the plug.

9. The method of claim 8, further comprising:

(e) actuating a plurality of spaced open hole packers into engagement with the tubular member and a sidewall of the wellbore after (e).

10. A method for cementing a tubular member within a subterranean wellbore extending from the surface into a subterranean formation and through a hydrocarbon reservoir, the method comprising:

(a) injecting a gas from the surface into an annulus surrounding the tubular member within the wellbore;

(b) pressurizing the gas in the annulus to push a fluid in the annulus downhole to a predetermined depth in the annulus;

(c) flowing cement into a throughbore of the tubular member after (a);

(c) displacing the cement from the throughbore of the tubular member into the annulus; and (d) bleeding the gas from the annulus during (c), wherein (d) further comprises maintaining a fluid pressure in the annulus equal to or greater than a reservoir pressure of the reservoir.

11. The method of claim 10, wherein (a) comprises filling the annulus with a gas and pressurizing the gas in the annulus to a predetermined pressure to push the fluid in the annulus downhole to the predetermined depth; and wherein (d) comprises reducing a pressure of the gas during (c).

12. The method of claim 10, further comprising:

(e) flowing the cement uphole through the annulus to a predetermined location in the annulus during (d), wherein the predetermined depth is based on the predetermined location.

13. The method of claim 10, wherein the gas injected into the annulus during (a) is an inert gas.

14. The method of claim 10, wherein (d) further comprises limiting the loss of cement into the subterranean formation to less than about 50 vol %.

15. The method of claim 10, wherein the gas injected into the annulus during (a) comprises one or more of a hydrocarbon gas, air, nitrogen, and carbon dioxide.

16. The method of claim 15, further comprising:

(e) actuating a plurality of spaced open hole packers into engagement with the tubular member and a sidewall of the wellbore after (e).

17. The method of claim 10, wherein (c) comprises:

(c1) closing a flow path through a plug disposed within the throughbore of the tubular member;

(c2) pumping a fluid into the throughbore above the plug after (c1); and (c3) displacing the plug toward a lower end of the tubular member during (c2).

18. The method of claim 17, wherein (c1) comprises:

flowing a dart within the throughbore of the tubular member; and engaging the dart with a dart seat on the plug.

* * * * *